US006772884B2

(12) United States Patent
Mathiez

(10) Patent No.: US 6,772,884 B2
(45) Date of Patent: Aug. 10, 2004

(54) ULTRA-FLAT BOX FOR INSERT

(75) Inventor: Jean-Louis Mathiez, Limours (FR)

(73) Assignee: Coty, S.A. (FR)

( * ) Notice: Subject to any disclaimer, the term of this patent is extended or adjusted under 35 U.S.C. 154(b) by 0 days.

(21) Appl. No.: 10/306,861

(22) Filed: Nov. 26, 2002

(65) Prior Publication Data

US 2003/0137144 A1 Jul. 24, 2003

Related U.S. Application Data

(63) Continuation of application No. PCT/FR01/01970, filed on Jun. 22, 2001.

(30) Foreign Application Priority Data

Jun. 30, 2000 (FR) ..... 00 08741

(51) Int. Cl.[7] ..... B65D 69/00
(52) U.S. Cl. ..... 206/581; 206/823; 428/35.7
(58) Field of Search ..... 206/484, 581, 206/823; 283/56; 132/333, 314; 428/35.7, 35.8, 905

(56) References Cited

U.S. PATENT DOCUMENTS

| | | | | | |
|---|---|---|---|---|---|
| 2,061,139 | A | * | 11/1936 | Cohen | 132/314 |
| 2,557,141 | A | * | 6/1951 | Rebora | 206/484 |
| 5,325,961 | A | | 7/1994 | Ford et al. | |
| 5,391,420 | A | * | 2/1995 | Bootman et al. | 428/905 |
| 5,439,172 | A | * | 8/1995 | Comyn et al. | 428/905 |
| 5,566,693 | A | * | 10/1996 | Gunderman et al. | 206/823 |
| 5,622,263 | A | * | 4/1997 | Greenland | 206/581 |
| 5,690,130 | A | | 11/1997 | Gunderman et al. | |
| 5,782,060 | A | | 7/1998 | Greenland | |
| 5,879,769 | A | | 3/1999 | Greenland et al. | |
| 6,326,069 | B1 | * | 12/2001 | Barnett et al. | 206/581 |

* cited by examiner

*Primary Examiner*—Luan K. Bui
(74) *Attorney, Agent, or Firm*—Schwegman, Lundberg, Woessner & Kluth, P.A.

(57) ABSTRACT

The present invention includes a box comprising a housing having a height of about 2 millimeters. The housing comprises a bottom portion. The bottom portion defines a bottom surface, an internal lateral flank, and a top bottom surface. The top bottom surface is elevated from the bottom surface, extending from the internal lateral flank. The box also includes a thin film and at least one weld that seals the thin film to the housing.

17 Claims, 3 Drawing Sheets

ULTRA-FLAT BOX FOR INSERT

RELATED APPLICATIONS

This application is a continuation under 35 U.S.C. 111(a) of International Application No. PCT/FR01/01970 filed Jun. 22, 2001 and published in French as WO 02/00507 A1 on Jan. 3, 2002, which claims priority under 37 U.S.C. 119 from French Application No. 00/08741 filed Jun. 30, 2000, which applications and publication are incorporated herein by reference.

The present invention concerns an ultra-flat box for inserting into newspapers or other general public or specialized magazines, said box containing a cast, pasty type product sample, volatile or otherwise, cosmetic or food.

In order to produce envelopes containing products to be inserted as inserts in the press, pouches formed from two sheets welded around the periphery are normally used. these sheets, comprised of a multi-layer composite material—aluminum, polyethylene, polyester—are not able to contain cast pasty products, but only a fine film of liquid or fluid.

Indeed, such containers must meet certain criteria in order to be accepted as an insert. In particular, they must be able to withstand a considerable pressure caused by the weight of the stacks (on pallets) in the storage areas or during transport. In general, distribution companies require said containers to withstand a load of 15000 N, applied for six seconds on the upper face. Said load must not cause any leak or bursting of the containers, so as not to risk soiling the merchandise.

There are microencapsulation coatings containing a few drops of perfume, the fragrance of which is dispersed after the coating is torn. However, microencapsulations can not contain a sufficient quantity of cast pasty products.

Also, there are deposits of very thin layers in serigraphy of a cosmetic product such as makeup foundation or lipstick, covered with a protective film. Once again, this method does not allow the use of a sufficient quantity of a cast pasty product or a product having a high volatility.

Also known, for example in the patent JP-A-91/73137, is the use of a perforated and embossed plastic, possibly furnished with a spacer, enclosed by two films of flexible plastic. Such methods have a high financial cost, and the plurality of glued or welded surfaces multiplies the risks of leaks or bursting.

The invention seeks to remedy the disadvantages of the state of the art, and in particular, to produce an ultra-flat box for press insert, making it possible to withstand a mechanical pressure of at least 15000 N and having and having a thickness of less than about 2 mm, while enabling a cast pasty product to be received in sufficient quantity to make it possible to evaluate the texture or to use it as a test, with a reasonable financial cost.

To accomplish this, the invention proposes combining a box made of thermoplastic material having a peripheral edge on which a sealing film is welded.

More specifically, a purpose of the invention is an ultra-flat box for insert comprising a housing suitable for receiving a cast pasty product with an overall height of the box of about 2 mm, in which the housing is limited by a bottom and an internal lateral flank with a peripheral edge that is raised relative to the bottom which has an upper face and a support face that are planar and parallel; the edge has an upper surface that is appreciably parallel to the bottom in order to receive by welding an seal formed form a thin film that covers the housing of the box and is welded to the upper face of the edge, and in which the relative radial dimensions of the edge of the box made of thermoplastic material are proportioned so as to withstand a mechanical pressure equal to at least approximately 15000 N distributed on its surface In addition to its decorative appearance, the box according to the present invention has a rigidity that makes it possible to package fragile products, such as pastes or emulsions, and it allows the visibility of an advertising page to be increased when it is inserted in a magazine. In fact, the rigidity of the box produces a "bookmark " effect that encourages the reader to open the magazine directly to the location of the advertising insert. Conventional pouches, comprised of flexible envelopes, are much less effective for that purpose.

According to special forms of embodiment:

- the thermoplastic material is injected in order to obtain the desired shape by molding; said material can be PP (polypropylene), PE (polyethylene), PET (polyethylene terephatalate) or ABS (acrylo-butadiene-styrene);
- the seal is made of a multilayer composite material, comprising at least a layer of thermoplastic material, such as PE or PP for example, in order to make the welding possible, and a "barrier " layer that can be composed of aluminum, in order to block the permeability of the thermoplastic material;
- in transverse cross section, the edge has a bridge shape with a collar resting on a connecting pillar integral with the bottom of the box, and an external pillar forming an edge, said edge having an upper face that is raised relative to the upper weld face of the collar, in such a way that after welding, the upper face of the edge and face of the seal are flush;
- the upper weld face of the seal is provided with circular cords to facilitate this welding, and transverse orifices are distributed along the edge in order to allow a suction to hold the seal prior to its being welded;
- the welding of the seal can be achieved thermally, by ultrasound or by induction, the PE or PP layer being fused to glue the thermoplastic material of the box;
- the bottom of the box has a thickness of between 0.3 and 1 mm, and the internal flank can be sloped at an angle of about 10 degrees flaring toward the bottom in order to keep the pasty product in place in the event its adherence to the plastic is not enough to hold it in place;
- the overall height of the edge is between about 1.5 and 2 mm;
- the bottom of the box can also appear in relief, for example capillary striations, intended to force the product to spread over the whole surface of the bottom of the box during casting;
- it is possible to increase the wettability of the plastic material by adding an additive (wetting agent) to the material, by a surface treatment intended to change the surface tension (surface-active agent) or an electrical treatment (corona, plasma), or a surface oxidation by flaming, for example; these operations, intended to improve the filling, have an effect on the quality of the produce and also on the production cost, but they make it possible to accelerate the casting operation on the machine, while ensure a good leveling of the pasty product even in the case of a very thin layer of paste;
- a decorative effect can be obtained on the surface of the product because, due to the thinness of the pasty product, an embossment on the bottom, optionally informative such as a logo or a text, is transferred to the surface of the product either by transparency if the pasty product is not totally opaque, or by "shading " of the surface if the product is totally opaque.

The box can contain any type of volatile or non-volatile products, such as cosmetics, lipsticks or makeup foundation for example, or food products in any pasty and cast form.

The present invention also has the advantage of making possible to packing of fragile products, such as pastes or emulsions, because of the obtained rigidity. It also promotes direct access to the page corresponding to the location of the box in the magazine, because its rigidity has a "bookmark " effect that is better than what is produced by the conventional pouches comprised of flexible envelopes.

Other characteristics and advantages of the invention will appear from the following description, relative to one form of embodiment, with reference to the appended figures which represent, respectively:

FIG. 1, a top view of one example of cylindrical shaped box according to the invention;

FIG. 2, a partial cross sectional view of the box along plane 2–2 of FIG. 1, the seal having been removed;

FIG. 3, a bottom view in perspective of a box provided with thin radial ribs;

FIGS. 4*a* to 4*d* are top view of various shapes of boxes according to the invention;

Figure 1:
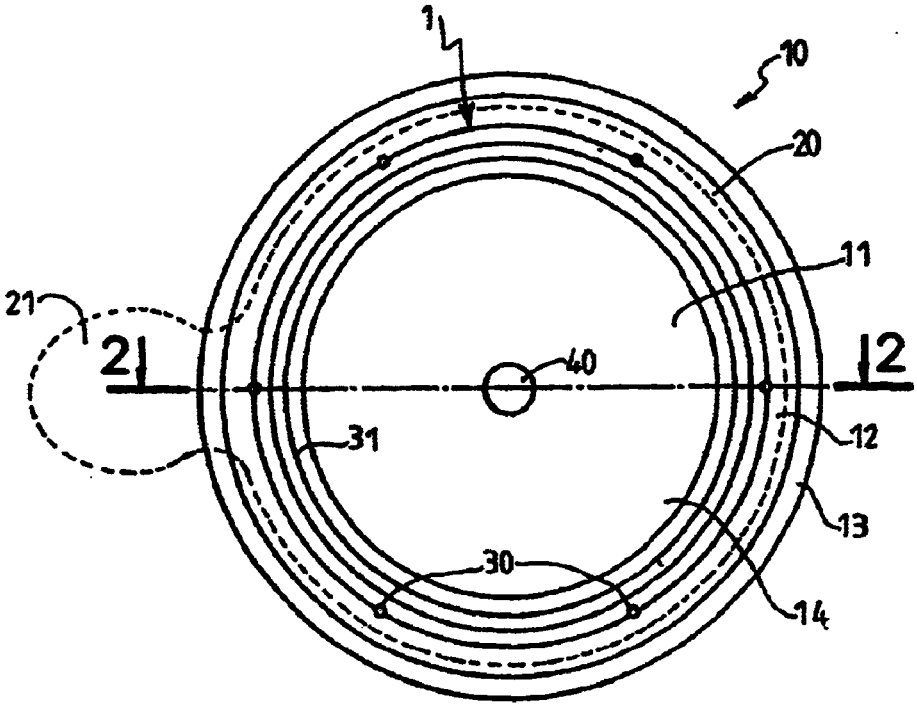

As illustrated in FIG. 1, an example of a box 10 for makeup foundation, according to the invention, has the overall shape of a polypropylene disk having a central bottom part 11, surrounded by an edge 1 composed of a circular collar 12 limited by a ring-shaped edge 13. The box 10 is closed by an seal 20, represented as being transparent in order to allow the box to show.

The seal 20 rests on the collar 12 and conforms to the inner contour of the edge 13 at the collar boundary. The seal 20 is provided with a tab 21 which, when pulled, detaches the seal to allow access to the makeup foundation in a housing limited by the bottom 11 and the collar 12.

Six transverse orifices 30 are regularly distributed around a median circle of the collar 12. These orifices allow the air to be sucked out by means of a suitable pump (not shown) in order to keep the seal in this position just before performing the weld. Circular ribbing cords 31 are also provided on the collar 12 in order to facilitate the heat sealing of the seal onto the collar.

The seal is formed from a film of aluminum composite material comprising a layer of polypropylene (PP) turned toward the box and which melts by heating, under conditions known to a person skilled in the art, to cause the welding of the seal onto the collar 12.

At the center of the box 10, a lens 40 corresponds to the polypropylene injection zone made in a mold adapted to the shapes and dimensions of the box, under known temperature and pressure conditions.

Figure 2:
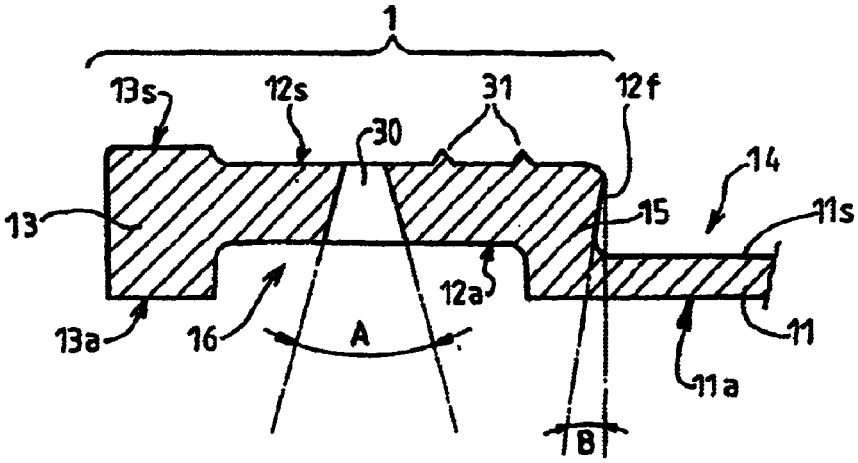

This lens 40 is also visible in FIG. 2, which illustrates a partial cross sectional view of the box along the sectional plane 2–2 indicated in FIG. 1. FIG. 2 shows the flat bottom 11, the housing for the makeup foundation 14, the collar 12 and the edge 13 of the box 10. The bottom 11 has an upper face 11*s* and a support face 11*a* that are planar and parallel. The housing 14 is formed by the space limited by the upper surface 1 is of the bottom 11, the lateral flank 12*f* of the collar 12 and the seal 20.

The collar 12 forms, in connection with the edge 13 and a connection base 15 with the bottom 11, a bridge around a ring-shaped recess 16 into which the transverse orifices 30 open. The edge 13 has a support surface 13*a* that is 25 mm in diameter, situated in the same plane as the support surface 11*a* of the bottom 11, and an upper surface 13*s*, raised 0.2 mm relative to the upper surface 12*s* of the collar 12. The overall height of the edge 13 is about 1.9 mm, the thickness of the collar 12 is about 1 mm, and the thickness of the bottom 11 is about 0.6 mm.

As illustrated in FIG. 2, the orifice 30 has the shape of a truncated cone with an aperture angle A of about 30 degrees, the ribs 31 have a height of about 0.2 mm, and the lateral flank 12*f* is sloped at an angle B equal to 10 degrees, so that the diameter of the housing 14 increases the upper surface of the collar 12*s* toward the upper surface of the bottom 11*s*.

The recess made in the collar 12 makes it possible to use a minimum of material in order to reduce costs as much as possible.

Figure 3:
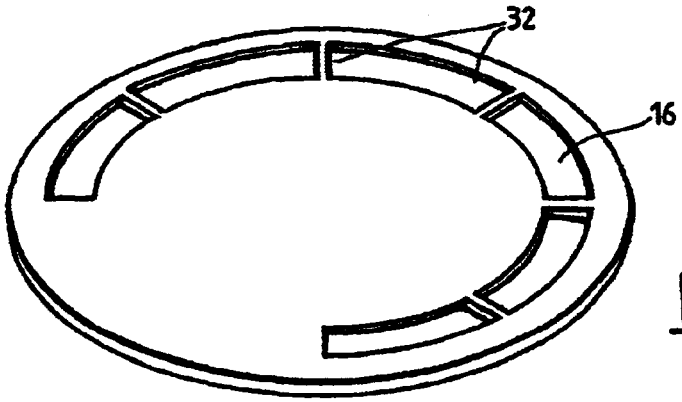

In order to reduce this thickness of material still more without losing the desired strength, as illustrated in FIG. 3, thin radial ribs 32 can be added, regularly spaced inside this recess 16.

The shape of the box and the decoration on its seal can be used for decorative purposes to reinforce the advertising slogan.

Figure 4A:
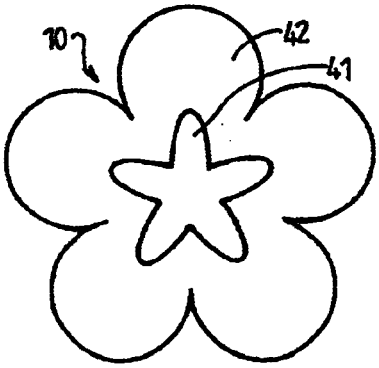
Figure 4B:
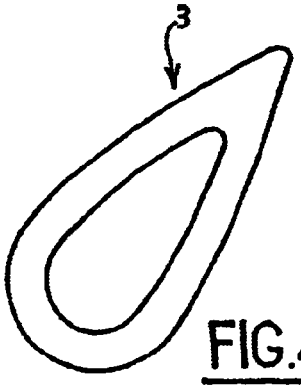
Figure 4C:
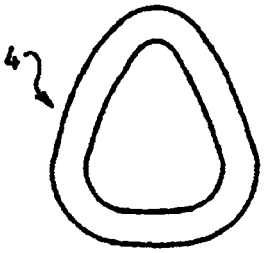
Figure 4D:
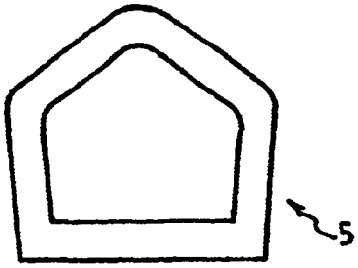

For that purpose, various shapes can be created, in conjunction with the product contained, optionally with a different shaped seal. For example, as illustrated in FIG. 4*a*, a flower shape 42 with a seal 41 and the housing filled with product of different shapes of the outer contour of the box 10. Any other technologically feasible shape can be considered: a teardrop 3 (FIG. 4*b*), oval shape 4 (FIG. 4*c*) or polygonal 5 (FIG. 4*d*).

Figure 5:
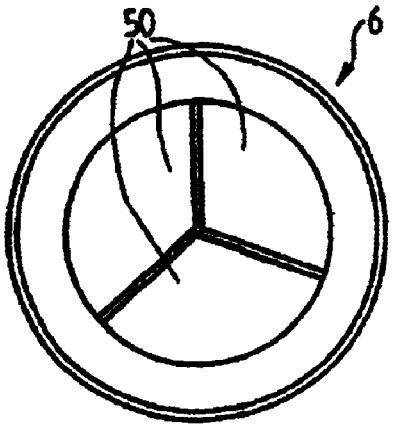
FIGS. 5 and 6 are top views of boxes with compartmentalized housings.
Figure 6:
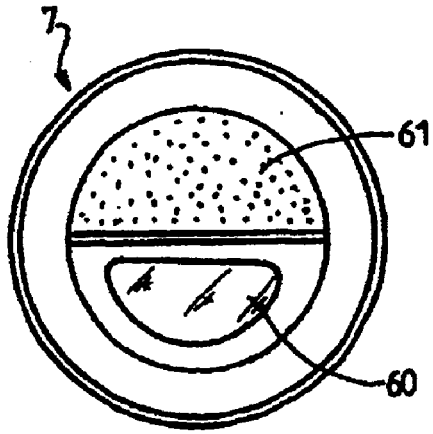

According to other forms of embodiment, and as illustrated in FIGS. 5 and 6, it is possible to provide several compartmentalized receptacles (50) in the boxes 6 and 7, in order to contain several types of different products, or to include an applicator specifically for the product, such as a small sponge 60 for a makeup foundation 61 or a small brush for lipstick.

Figure 7:
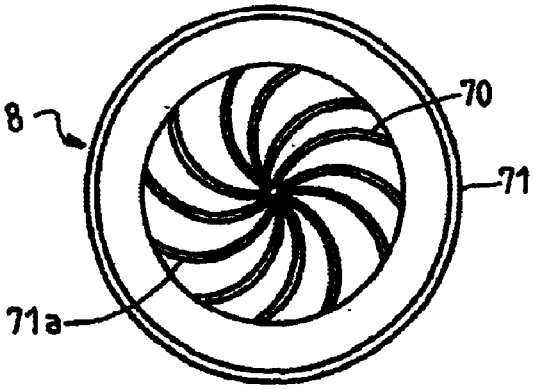
FIG. 7 is a bottom view of a box having striations for the distribution of the product.

Moreover, with reference to FIG. 7, the bottom 71 of the box 8 has on its outer contact surface 71*a* radial and curved capillary striations 70, intended to force the product to spread over the whole surface of the cavity during casting. Because a hot cast product tends to congeal in contact with the plastic, and not to cover the whole surface of the cavity, "holes " can form around the periphery or in the corners for non-circular shapes, and this filling defect can be exacerbated by the fact that the height of the pasty product is very small.

Figure 8:
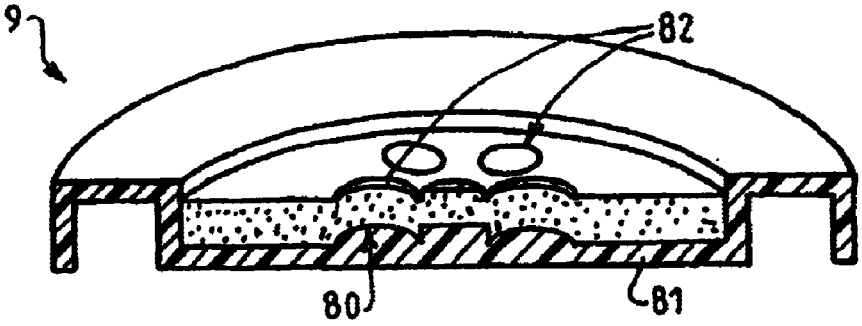
FIG. 8 is a cross sectional view of a box having a bottom capable of producing a decorative effect on the surface of the housed product.

In addition, as shown in FIG. 8, a decorative effect can be obtained on the surface of the product as a result of the small height of the pasty product. Embossments 80 made on the bottom 81 of the box 9 are transferred to the surface of the product where the decorative elements 82 appear in corresponding relief.

The height of the embossment causes a relatively large variation in thickness of the product and the slight shrinkage of the paste during its cooling reproduces the subdued motif on its surface. This produces a shaded effect that is more or less visible depending on the coloration pigments used in the paste.

Furthermore, pigments having a flattened shape, such as spangles or mother-of-pearl, tend to be oriented in areas of variation of thickness, thus enhancing the optical effect of the product. These elements, optionally informative, such as a logo or a text, appear either by transparency if the pasty product is not totally opaque, or by "shading " of the surface if the product is totally opaque.

The invention is not limited to the forms of embodiment described and represented here.

The ultra-flat box according to the invention can be glued by its bottom to a journal or magazine page, possibly integrated into an advertising graphic creation. The box according to the invention can also be inserted unglued into a publication, held for example by a strip of paper or plastic, or by an envelope.

Several boxes according to the invention can be glued to the same page, thus allowing several products in the same line to be introduced.

The seal can also be comprised of transparent material to allow the texture and color of the product to be seen.

It is also possible to use the ultra-flat box according to the invention alone or grouped for mailings, for which its resistance to heavy weight as well as its thinness will be appreciated.

Distribution free of charge (samples) or for consideration (mini-doses) of the box according to the invention at a point of sale can also be considered.

This box can also be inserted in mailings or greeting cards for professional or recreational purposes.

What is claimed is:

1. A box, comprising:

a housing having a height of about 2 millimeters, the housing comprising a bottom portion, the bottom portion defining a bottom surface, an internal lateral flank, and a top bottom surface, elevated from the bottom surface, extending from the internal lateral flank wherein one or more circular cord extends upward from the top bottom surface;

a thin film overlaying the housing; and one or more welds that seal the thin film to the top bottom surface wherein the box is capable of withstanding a load of at least about 15,000 N.

2. The box of claim 1 wherein the housing is made from one or more of polypropylene, polyethylene, polyethylene terephthalate or acrylo-butadiene-styrene.

3. The box of claim 1, further comprising a product within the box.

4. The box of claim 1 wherein the film comprises a multilayer composite material, wherein at least one layer comprises the weld that seals the film to the top bottom surface of the housing.

5. The box of claim 1 wherein the film comprises one or more of polyethylene terephthalate, aluminum and polyethylene.

6. The box of claim 1 wherein the bottom portion of the housing further comprises an external pillar that has an elevated top bottom surface, adjacent to the lateral flank.

7. The box of claim 6 wherein the bottom portion has a bridge shape in cross-section.

8. The box of claim 6 wherein the elevated top bottom surface is overlaid with a weld formed from the film.

9. The box of claim 3 wherein the housing further comprises capillary striations effective for spreading product over the bottom portion of the housing.

10. The box of claim 1 wherein the housing further comprises an embossment transferrable to the product.

11. The box of claim 1 wherein the bottom portion has a thickness of between 0.3 and 1 mm.

12. The box of claim 1, further comprising a tab, the film adhered to the tab.

13. The box of claim 1, further comprising a lens defined by the housing.

14. The box of claim 1 wherein the housing and film define multiple receptacles.

15. An advertisement system, comprising:

a box, comprising:

a housing having a height of about 2 millimeters, the housing comprising a bottom portion, the bottom portion defining a bottom surface, an internal lateral flank, and a top bottom surface, elevated from the bottom surface, extending from the internal lateral flank wherein one or more circular cords extend upward from the top bottom surface;

a thin film overlaying the housing;

a product disposed in the box; and one or more welds that seal the thin film to the top bottom surface wherein the box is capable of withstanding a load of at least about 15,000 N; and a magazine, newspaper, or journal wherein the box is inserted in the magazine, newspaper, mailing, card, or journal.

16. The advertisement system of claim 15 wherein the magazine, newspaper, mailing, card, or journal has a graphical display and the box is positioned integrally with the graphical display.

17. A box, comprising:

a housing having a height of about 2 millimeters, the housing comprising a bottom portion, the bottom portion defining a bottom surface, an internal lateral flank, and a top bottom surface, elevated from the bottom surface, extending from the internal lateral flank wherein the top bottom surface defines one or more orifices effective for imparting a suction to hold the film prior to being welded;

a thin film overlaying the housing; and one or more welds that seal the thin film to the top bottom surface wherein the box is capable of withstanding a load of at least about 15,000 N.

* * * * *